US007225593B2

(12) United States Patent
Wilhour

(10) Patent No.: US 7,225,593 B2
(45) Date of Patent: Jun. 5, 2007

(54) POST-FRAMING SYSTEM

(76) Inventor: Weston Wilhour, R.R. 3 Box 125, Altamont, IL (US) 62411

( * ) Notice: Subject to any disclaimer, the term of this patent is extended or adjusted under 35 U.S.C. 154(b) by 212 days.

(21) Appl. No.: 10/670,967

(22) Filed: Sep. 25, 2003

(65) Prior Publication Data

US 2005/0066615 A1 Mar. 31, 2005

(51) Int. Cl.
*E04B 1/18* (2006.01)
*E04B 1/26* (2006.01)

(52) U.S. Cl. ..... 52/653.1; 52/210; 52/284; 52/481.1; 52/483.1

(58) Field of Classification Search ..... 52/311, 52/476, 489.1, 455, 210, 271, 286, 581, 270, 52/284, 474, 481.1, 483.1, 653.1
See application file for complete search history.

(56) References Cited

U.S. PATENT DOCUMENTS 3,938,294 A 2/1976 Gaburri
4,577,444 A * 3/1986 Sanderson ..... 52/475.1
4,765,105 A * 8/1988 Tissington et al. ..... 52/309.11
5,095,671 A * 3/1992 Mitani ..... 52/210
6,318,044 B1 * 11/2001 Campbell ..... 52/645
6,412,249 B1 * 7/2002 Boyer et al. ..... 52/731.9
6,427,407 B1 * 8/2002 Wilson ..... 52/481.1
6,550,198 B1 * 4/2003 Endo et al. ..... 52/271
6,772,572 B2 * 8/2004 Henthorn ..... 52/731.2

* cited by examiner

*Primary Examiner*—Naoko Slack
*Assistant Examiner*—Yvonne M. Horton
(74) *Attorney, Agent, or Firm*—Fleit Kain Gibbons Gutman Bongini & Bianco; Paul D. Bianco; Martin Fleit

(57) ABSTRACT

The present invention provides a post-framing system for building construction. The post-framing system includes support posts and wall sections that can be prefabricated and transported to the job site for assembly. The support posts are at least 3-ply, having an upper ply member, a lower ply member, and at least one middle ply member attached to and interposed between the upper and lower ply members. Pre-framed low and high wall sections are attached to the support post to form the building frame.

20 Claims, 10 Drawing Sheets

POST-FRAMING SYSTEM

FIELD OF THE INVENTION

The present invention relates to a building construction system, and more particularly to a post-framed building construction system.

BACKGROUND OF THE INVENTION

Traditionally, post-framed buildings were marketed towards the farm/ranch and industrial/commercial population for general machine storage and warehousing. However in recent years these types of buildings have become more popular in more up-scale environments such as residential neighborhoods, being used, for example, in vehicle/camper/boat storage, woodworking shops, paint shops, small-scale mechanics shops, or just a place for the common retiree to "piddle." There is also a growing population who use these types of buildings as dwellings or summer homes on rivers or lakes. The change in consumer base and application has increased the need to heat and cool these buildings, which require conformity to local and regional building codes, such as, insulation and electrical wiring.

The traditional method for constructing a post-framed building is by framing the building perimeter with support posts. For example, a series of 6×6 treated post or 3-ply 2×6 laminated poles are positioned on eight foot centers about the building perimeter. The support posts are positioned at a vertical depth of four feet, with the above ground height of the support post equaling the eve height. After the support posts are set (which can be quite difficult with increasing eve height due to the length of the 6×6 support post and the need for man power or machine) and temporarily braced, the side girts or "nailers" are added. The girts are most commonly 2×4-16' and are placed flat ways on the outside of the post at 24" on center up the support post. A skirt board can be added and consists of two or more rows of treated 2×6-16' tongue and groove nailed at the outside base of the support posts flat ways with the bottom row contacting the ground. After the girts and the skirt boards are placed on all four sides of the building, the trusses are added.

The trusses are placed on eight foot centers and fastened to the top side of the support post at the desired eve height, being supported by the support post. Purlings (roof "nailers") are nailed parallel to the walls at 24" on center. The purlings are 2×4 nailed on edge. Corrugated steel is added to the roof and nailed or screwed to the purlings. The side steel is added and screwed to the side girts.

While the traditional system has worked well for many years, it has some deficiencies. For example, the traditional system lacks flush mounting surface for the attachment of inside liners (plywood, OSB, or corrugated steel). As a result, the consumer who chooses to insulate and line the inside walls and ceiling has increased construction cost in material and man hours for the construction of the flush mounting surfaces.

The traditional system also has its disadvantages for the building contractor. Of main concern to the contractor is to erect a building in a timely manner without compromising quality. In order to accomplish this one must have the machinery and tools necessary to provide a safe and efficient working environment. One disadvantage to the traditional system is the higher the eve height of the building, the longer the posts become, making them very heavy and awkward to handle with manpower, and, in many locations, awkward to maneuver even with machinery.

Accordingly, a need for an improved post-framed system exists. Ideally, the system will benefit both the consumer and the contractor to increase cost effectiveness, efficiency, and productivity. Additionally, the system will be more economical and increase building quality to the consumer who intends to insulate and finish the interior of the building and will be adaptable to any style, shape, or size of building.

SUMMARY OF THE INVENTION

The present invention provides a post-framing system for building construction. The post-framing system includes a plurality of support posts. Each of the support posts includes an upper ply member, a lower ply member, and at least one middle ply member attached to and interposed between the upper ply member and the lower ply member. The support posts are positionable in the ground to define a perimeter of a building. The support post are positioned and cut in place such that the lower ply members of alternating pairs of adjacent support posts face each other.

A plurality of low wall sections are included, which are attachable to the lower ply members of alternating pairs of adjacent support posts. A plurality of high wall sections are included, which are attachable to the upper ply members of alternating pairs of adjacent support posts.

In a method of use, the framing for a building is construction by positioning each of the support posts vertically in the ground to define the buildings perimeter, wherein at least three of the support posts are corner support posts. The support post with the highest ground elevation is determined and marked. On the highest ground elevation support post, the low wall base line and the high wall base line are determined. The low and high wall base lines are then transferred to each of the support posts.

The support posts are cut at the low wall base lines and the high wall base lines, forming the lower ply members and the upper ply members. The support posts are cut such that the lower ply members are formed facing each other on alternating pairs of adjacent support posts and the upper ply members are formed facing each other on alternating pairs of adjacent support posts.

The corner support posts are prepared to receive the sidewalls and the end wall, by flushing the end wall outside surface and attaching an end wall support block to the corner support posts. The low side and end wall section are attached to the lower ply members, and the high side wall and end wall sections are attached to the upper ply members.

After assembly of the frame of the building, the outside siding, roof and purling are attached to the building frame.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
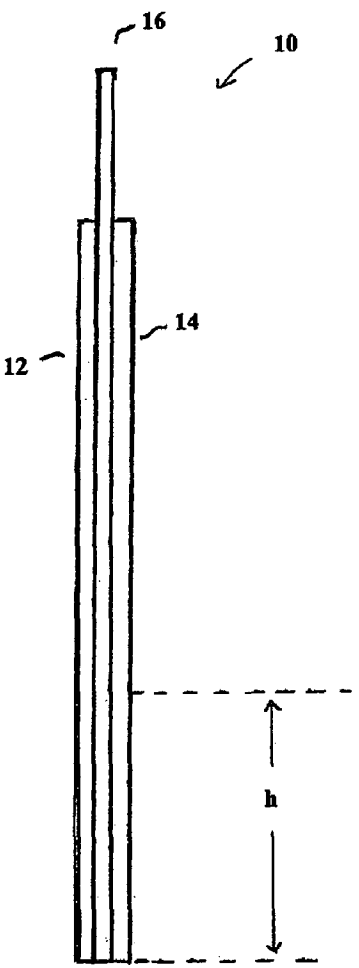
FIG. 1 is a front view of a support post of the present invention.

The present invention provides a prefabricated post and wall system for building constructions. The systems can be prefabricated at a location remote from the construction site, and, if desired, modified at the construction site. Alternatively, the system can be constructed at the construction site. Referring now to the drawing figures in which like reference designators refer to like elements, there is shown in FIG. 1 a support post 10 for the present invention. The support posts 10 of the present invention are laminated posts, including at least three ply-members, assembled by combining, a lower ply member 12, an upper ply member 14, and at least one middle ply member 16. For example, the ply members can be 2×6 treated lumber, wherein the height of the middle ply member 16 is dependent on the sidewall height of the building (increasing sidewall height=increasing middle ply length). The ply members 12, 14, 16 are assembled by attaching the lower and upper ply members 12, 14 to the middle ply member 16, wherein the middle ply member 16 is interposed between the lower and upper ply members 12, 14. The bottom end of the upper ply member 14 is flushed with the bottom end of the middle ply member 16 and attached to one side of the middle ply member 16. The bottom end of the lower ply member 12 is flushed with the bottom end of the middle ply member 16, wherein only the lower section "h" is attached to the middle ply member 16, wherein "h" can be about 2–6 feet. Although the entire length of the lower ply member 12 could be attached to the middle ply member 16, by limiting the attachment to the lower section, removal of a top portion of the lower ply member 12 is facilitated.

Figure 4:
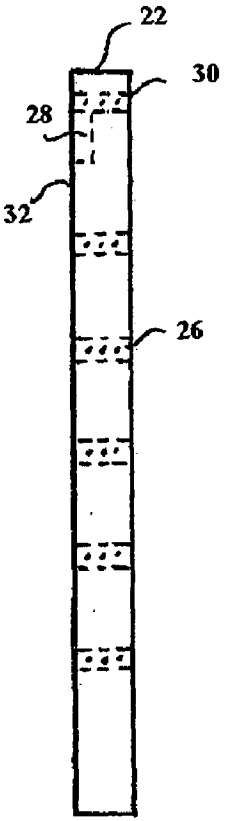
FIG. 4 is a side view of the low sidewall section of FIG. 3.
Figure 3:
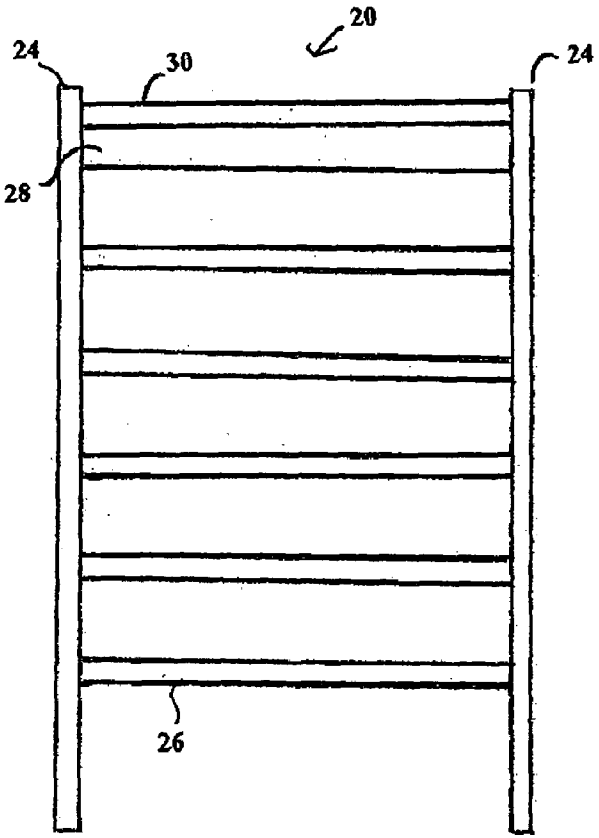
FIG. 3 is a front view of a low sidewall section of the present invention.
Figure 2:
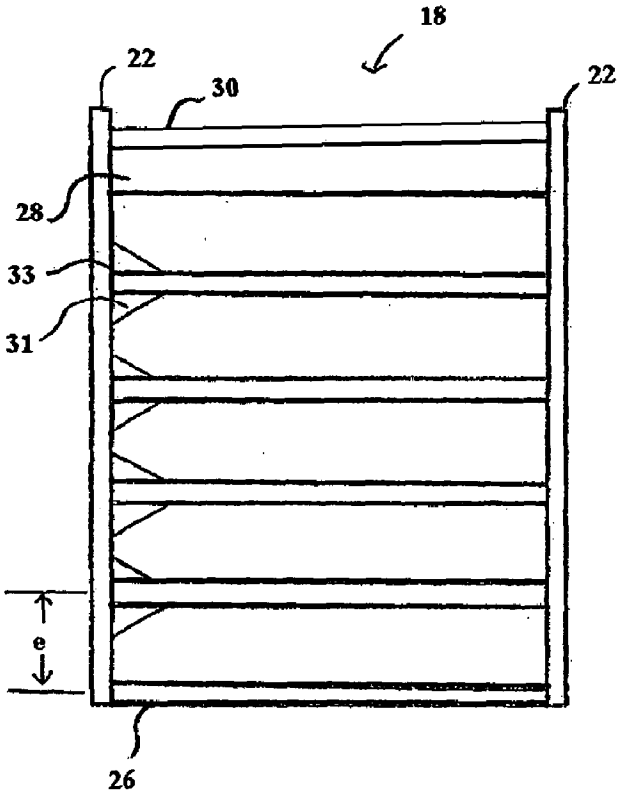
FIG. 2 is a front view of a high sidewall section of the present invention.

Referring to FIGS. 2–4, the sidewall sections include a high wall section 18 and a low wall section 20, wherein the height of the sidewall sections 18, 20 is dependent on eve height of the building. The high and low sidewall sections 18, 20 are attachable to adjacent support posts 10 setup, for example, on eight foot centers. The high and low sidewall sections 18, 20 each include a pair of vertical side jamb members 22, 24 (respectively) with a plurality of horizontal studs 26 affixed to and interposed between the pair of side jamb members 22, 24. The lower ends of the high sidewall section jamb members 22 are shorter than the lower ends of the low sidewall section jamb members 24 to ensure that there is no alignments of joints when the high and low sidewall sections 22, 24 are attached to the support posts 10. Although the high and low sidewall sections 18, 20 could be made to have the same height, the misalignment of the joints creates a stronger frame without the need for additional strengthening measures. In an exemplary embodiment the lower ends of the high sidewall section jamb members 22 measure about 22¼ inches less than the lower ends of the low sidewall section jamb members 24. When set in place, the wall jambs 22, 24 make up the outside plies of the support posts 10. In fabrication, the high and low sidewalls 18, 20 and the high and low sidewall jambs 22, 24 are cut to length. The horizontal studs 26 are cut to length and attached to the jamb members 22, 24 a distance "e" on center, where in e can be, for example, 18–30 inches. The sidewall member 18, 20 can be assembled in a jig to square the sidewall during assembly. At the top end of the high and low sidewall sections 18, 20 a headboard 28 is attached directly under the top most horizontal stud 30 flush with the outside surface 32 of thc sidewall 18 or 20. This headboard 28 is optional on the end wall sections, which are described below.

Additionally, a gusset 31 can be attached to the sidewall members 18, 20. The gussets 31 is a flat, often triangular plate, used to connect and reinforce the joint 33 between the vertical side jamb members 22, 24 and the horizontal studs 26. The gusset 31 can be made of metal, wood, or manufactured lumber.

Figure 6:
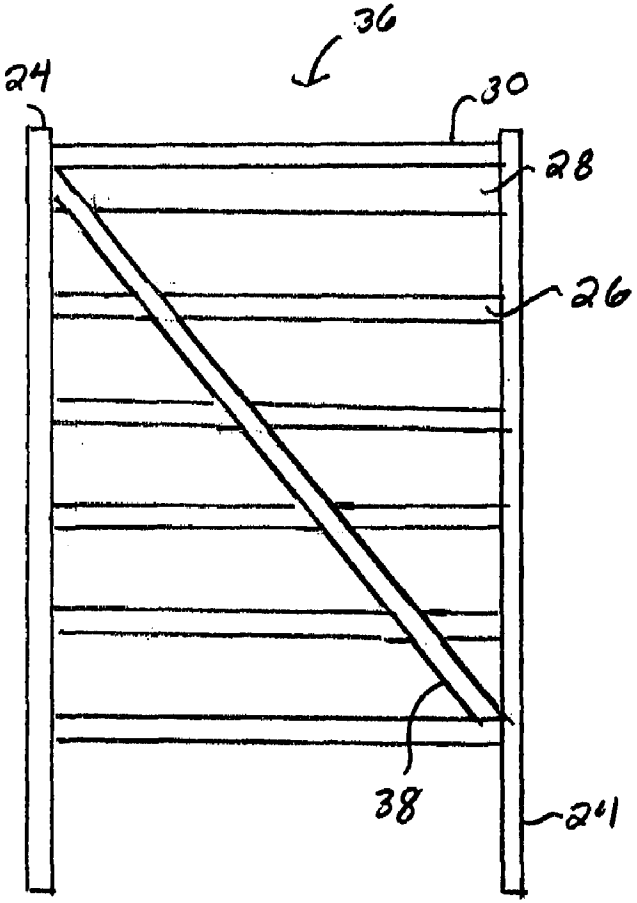
FIG. 6 is a front view of a low sidewall section of the present invention including an angle brace.
Figure 5:
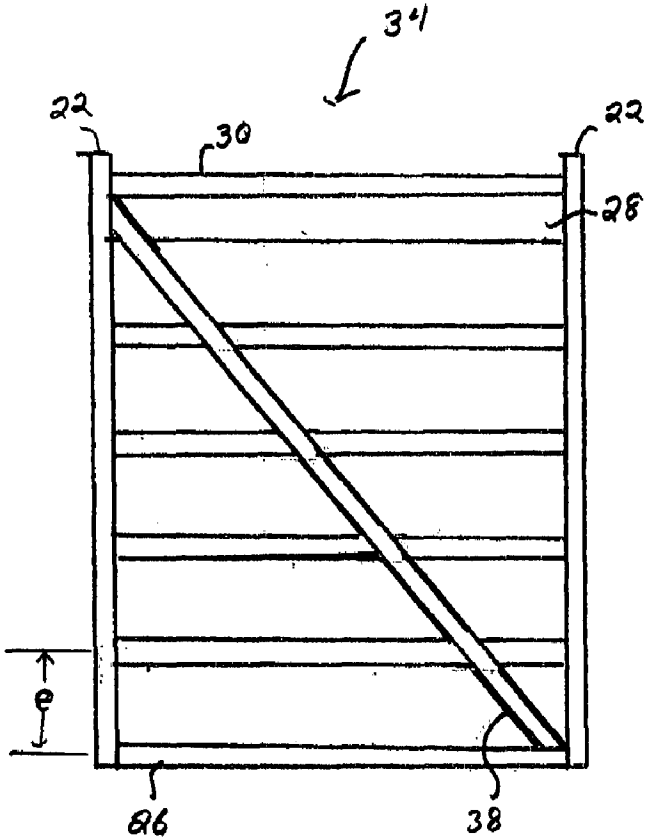
FIG. 5 is a front view of a high sidewall section of the present invention including an angle brace.

Referring to FIGS. 5 and 6, the corner high and low sidewall sections 36, 38 can include an angle brace 38 mortised into the outside surface 32 of the sidewall 36, 38 for additional strength and support.

Figure 9:
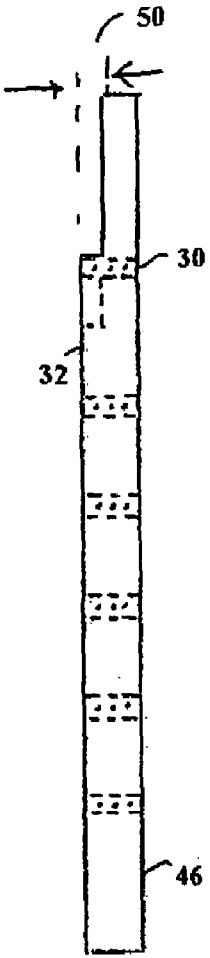
FIG. 9 is a side view of the end wall section of FIG. 8.
Figure 8:
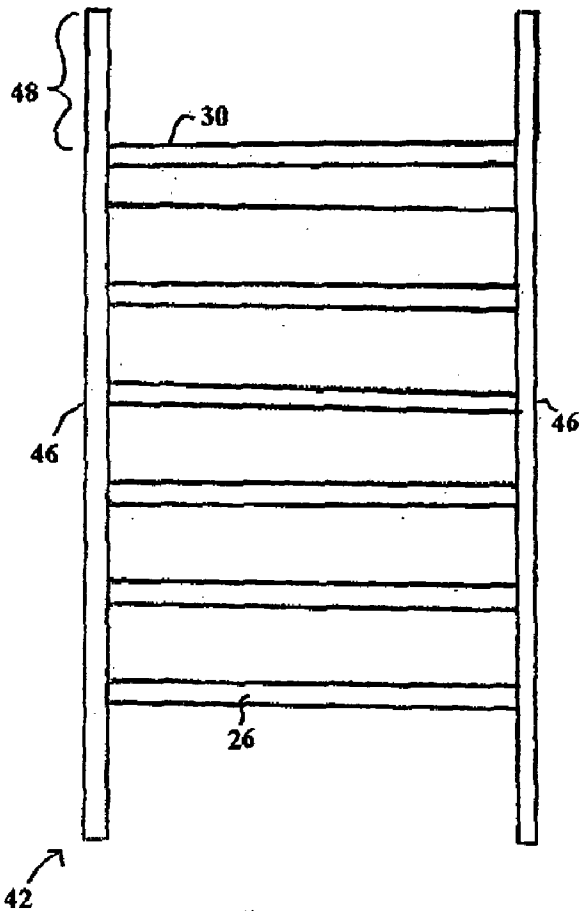
FIG. 8 is a front view of a low end wall section of the present invention.
Figure 7:
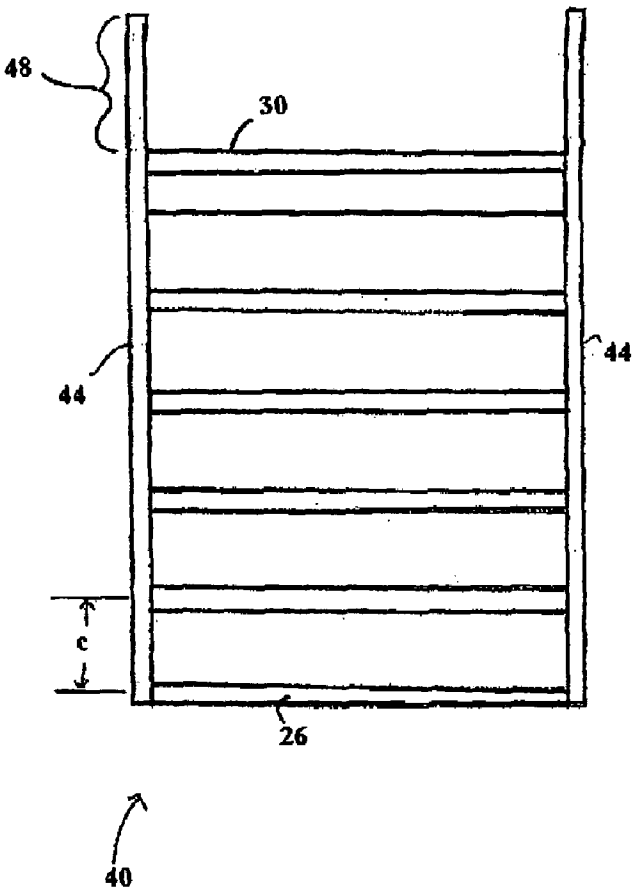
FIG. 7 is a front view of a high end wall section of the present invention.

Referring to FIGS. 7–9 the high and low end wall sections 40, 42 or the gable ends are manufactured similar to the low and high sidewall sections 18, 20. However, the jambs 44, 46 of the high and low end wall section 40, 42 (respectively) extend to a greater extent above the top most horizontal member 30. The jambs 44, 46 extend a sufficient height to match the gable height of the roof, and then cut to match the pitch of the roof. The extended portion 48 of the jambs 44, 46 include a notch 50 cut even with the top most horizontal stud 30, allowing a truss to be set in flush with the outside surface 32 of the end walls 40, 42. Additionally, similar to the corner sidewall section 36, 38, as shown in FIG. 5, the corner end wall sections can include an angle brace mortised into the outside of the end wall for additional strength and support.

Figure 10:
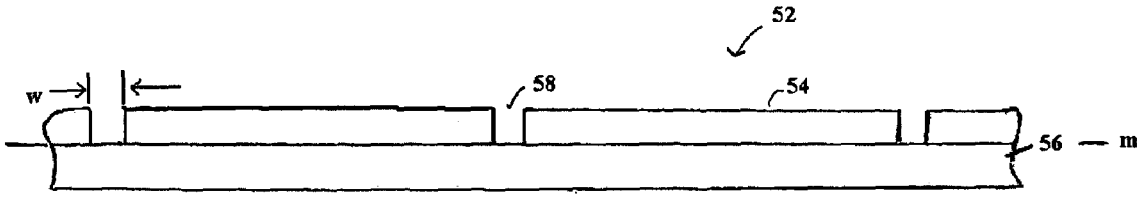
FIG. 10 is a front view of a skirt of the present invention.
Figure 11:
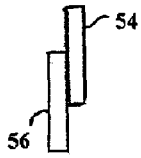
FIG. 11 is a side view of the skirt of FIG. 10.

Referring to FIGS. 10 and 11, the skirt board 52 is assembled, wherein the skirt board 52 includes at least two pieces of lumber horizontally staggered. The skirt board 52 includes an inner skirt 54 and outer skirt 56, wherein the outer skirt 56 is attached to the inner skirt 64 at the mid-line "m" of the inner skirt 54. The inner skirt 54 is notched 58, such that the inner skirt 54 can be position flush with the support posts 10. For example, when the support posts 10 are positioned eight foot on center, the inner skirt 54 includes a plurality of notches 58 having a width "w" equal the width of a support posts 10, spaced eight feet on center. The skirt board 54 serves as a seal between the ground and the bottom of the building, a bottom nailer for the siding, and also a jig during support post placement.

Figure 12:
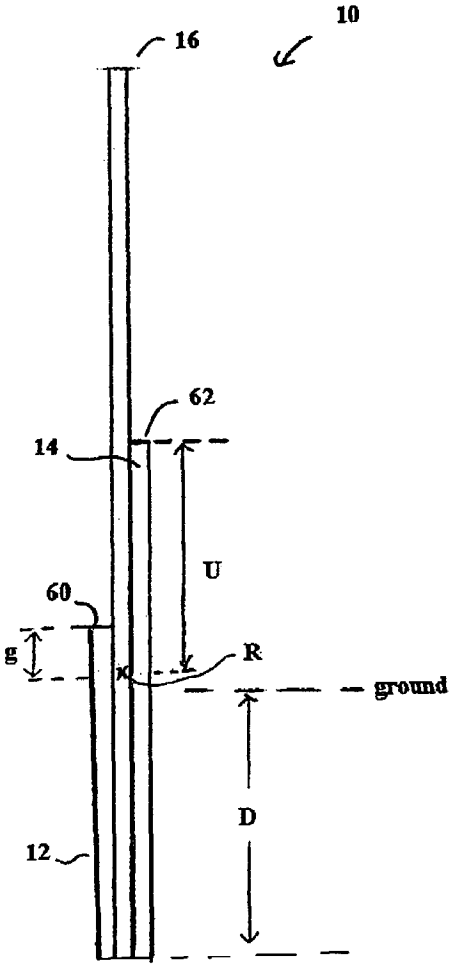
FIG. 12 is a front view of a support post of the present invention cut to include upper and lower ply members.
Figure 13:
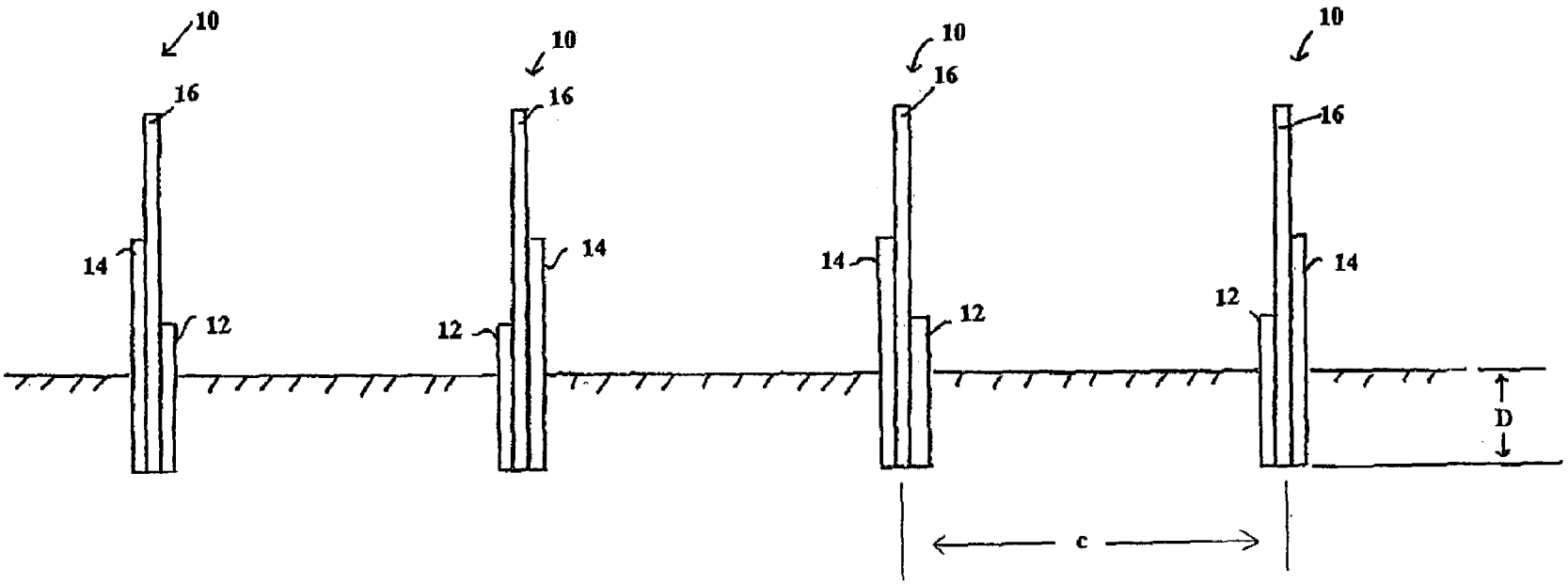
FIG. 13 is a plan view of the support posts of the present invention positioned in the ground.

Referring to FIGS. 12 and 13, support posts 10 are positioned in the ground, bottom end down, at a vertical depth "D." The vertical depth "D" can be dependent on local municipal building codes and can be, for example, between about two and six feet. The support posts 10 are plumbed to ensure a vertical position. The support posts 10 are positioned a distance "c" apart, wherein "c" can be dependent on local municipal building codes or customs, for example, being about eight feet on center. The skirt board 52 can be used as a jig to align the support posts 10. After all the support posts 10 have been positioned, the lower and upper ply members 12, 14 are graded.

A transit is setup and a reference mark is placed at the same grade on all corner posts and, for example, every twenty-four feet there between. The support post 10 with the highest ground elevation around the perimeter of the building is determined and marked with a reference mark "R". A measurement is taken from the reference mark "R" to a distance "g" above the ground and marked. The distance "g" is of sufficient length to ensure that the skirt can be substantially horizontally positioned around the perimeter of the building, wherein "g" can be, for example, about 4 to 8 inches. This point is the baseline 60 of the low wall sections 20. A distance "u" is measure up from the low wall baseline 60 and marked, wherein the distance "u" is of sufficient length to ensure that there is no alignment of joint within the support posts 10. For example, the distance use can be about 18 to 26 inches. This point is the baseline 62 of the high wall section 18. The high and low wall base lines 60, 62 are transferred to each of the remaining support posts 10. The lower ply member 12 is cut at the low wall base line 60 and the upper ply member 14 is cut at the high wall base line 62, wherein the upper and lower ply members 12, 14 of adjacent support posts 10 should be facing each other such that the high and low wall sections 18, 20 will alternate.

Figure 14:
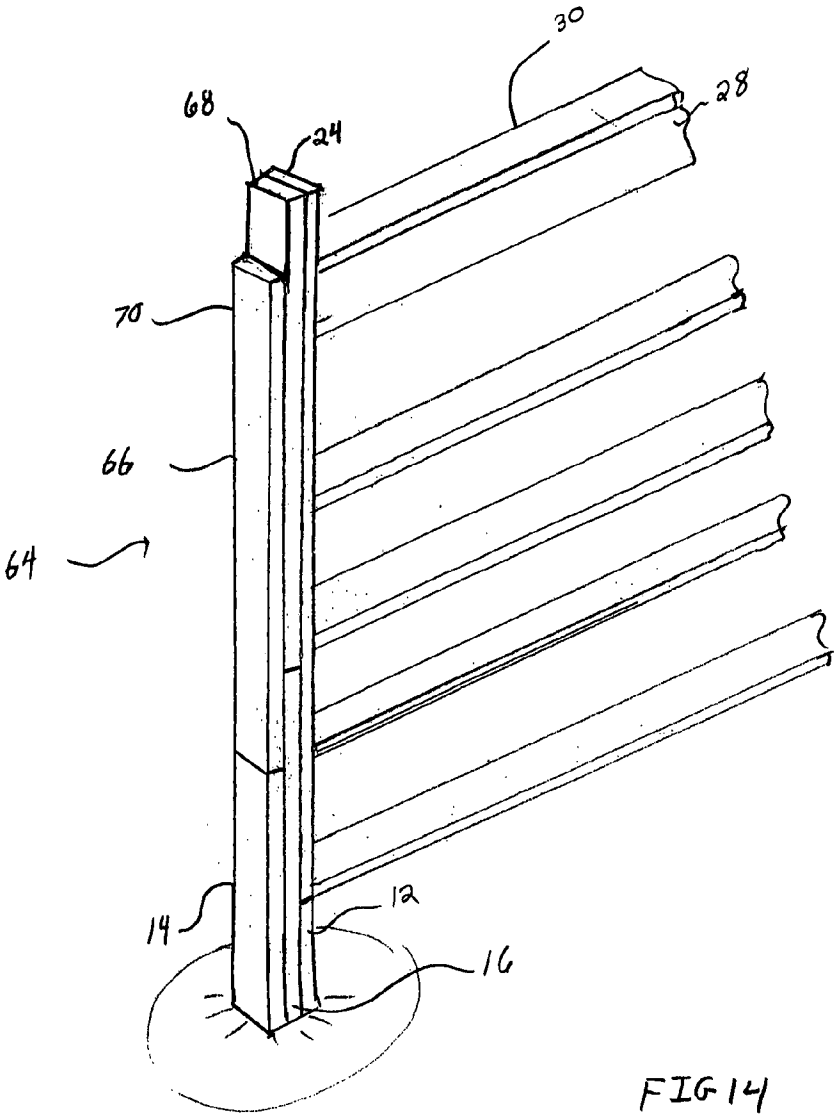
FIG. 14 is a sectional perspective view of a corner support post of the present invention.
Figure 15:
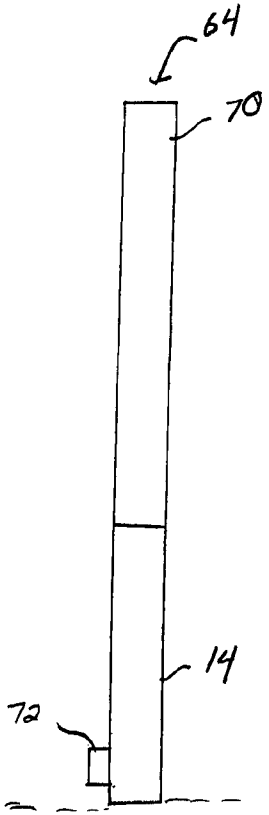
FIG. 15 is a side view of a corner support post of the present invention including an end wall support block.

Referring to FIGS. 14 and 15, the corner support posts 64 are prepared by flushing the end wall outside surface 66 of the corner support posts 64. For example, when the corner sidewall is a low wall section 20, the end wall outside surface 66 of the corner support post 64 is flushed by attaching a first support member 68 to the top of the middle ply member 16 and the sidewall jamb 24 and a second support member 70 to the top of the upper ply member 14 and the first support member 68. The first support member 68 is sized to match the height of the sidewall jam 24. The second support member 70 is sized to match the height of the top most horizontal stud 30, such that a notch 50 is formed on the corner support post 64, allowing a truss to be set in flush with the outside surface 32 of the end walls 40, 42. The corner support post 64 is prepared to accept an end wall section 40 or 42 by attaching an end wall support block 72 to the corner support post 63, wherein the end wall support block 72 is sized to receive a high wall or a low wall section 40, 42.

Figure 16:
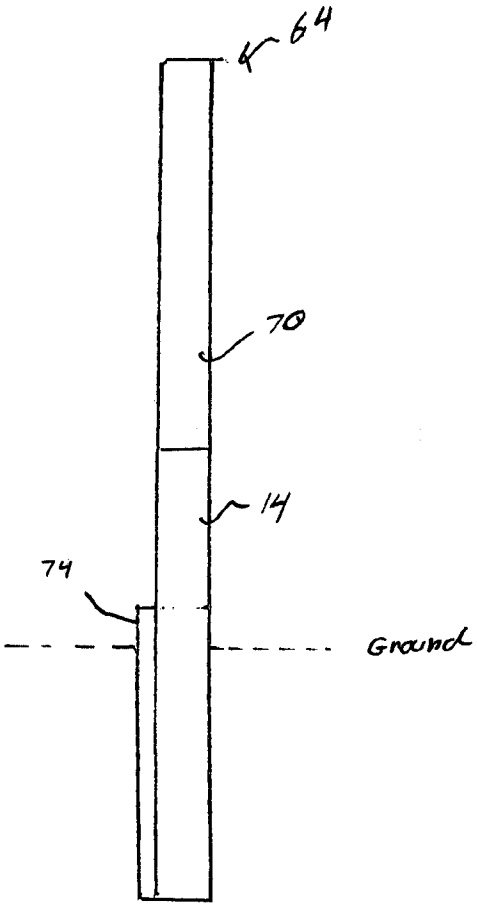
FIG. 16 is a side view of a corner support post of the present invention including an end wall ply member.

Alternatively, as shown in FIG. 16, an end wall ply member 74 can be attached to a corner support post 64, wherein the bottom end of the end wall ply member 74 is flushed with the bottom ends of the upper, lower and middle ply members 12, 14, 16, being attach perpendicular to the upper, lower, and middle ply members 12, 14, 16. After the corner support posts 65 have been positioned in the ground, the support post with the highest ground elevation is determined as stated above. The high and low wall base lines 60, 62 are transferred to the end wall ply member 74. If the corner end wall section is a low wall section 42, the end wall ply member 74 is cut at the low wall base line 60. If the corner end wall section is an upper wall section 40, the end wall ply member is cut at the high wall base line 62.

Figure 17:
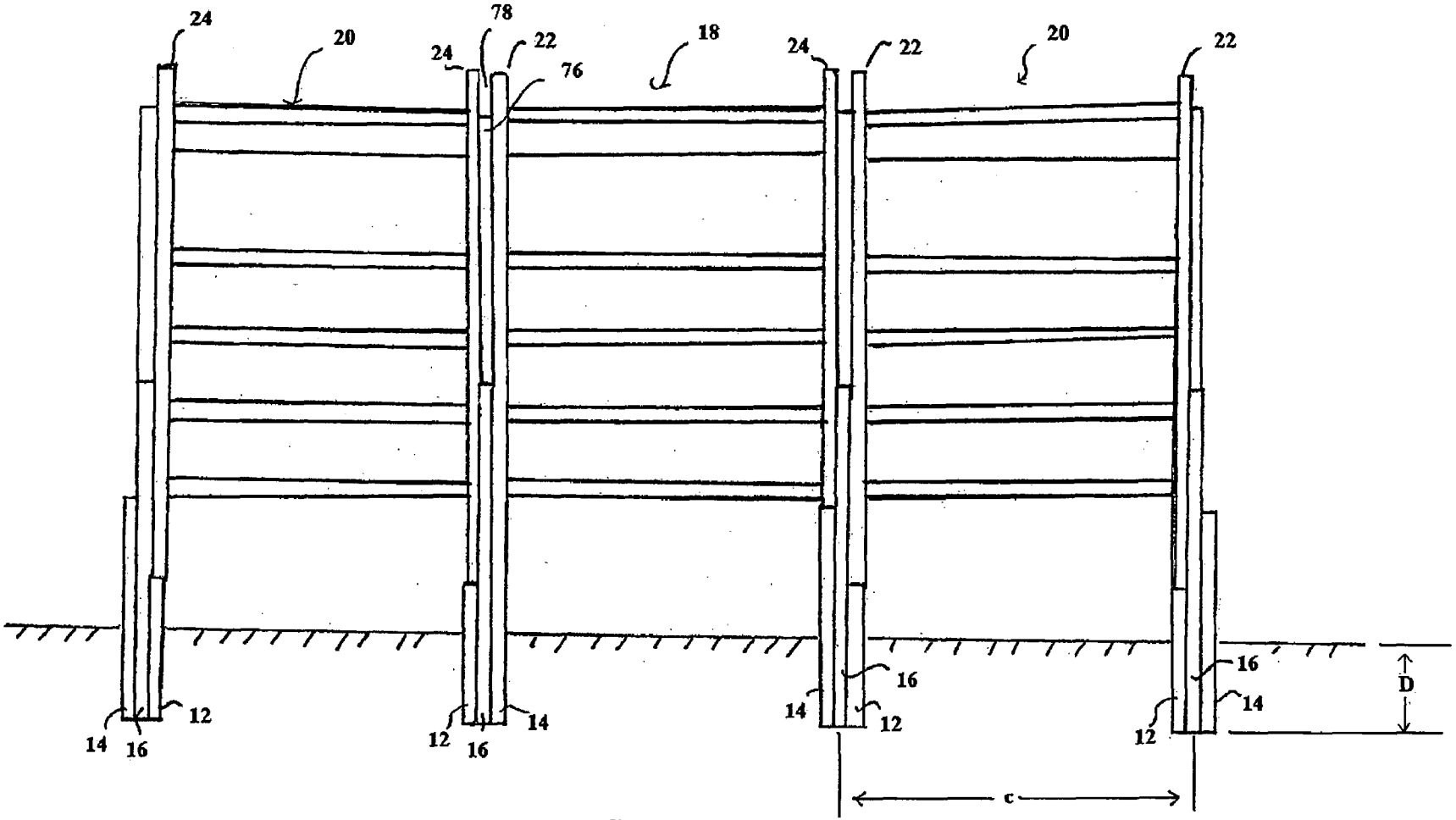
FIG. 17 is a plan view of the high and low wall sections attached to the support posts of the present invention.
Figure 18:
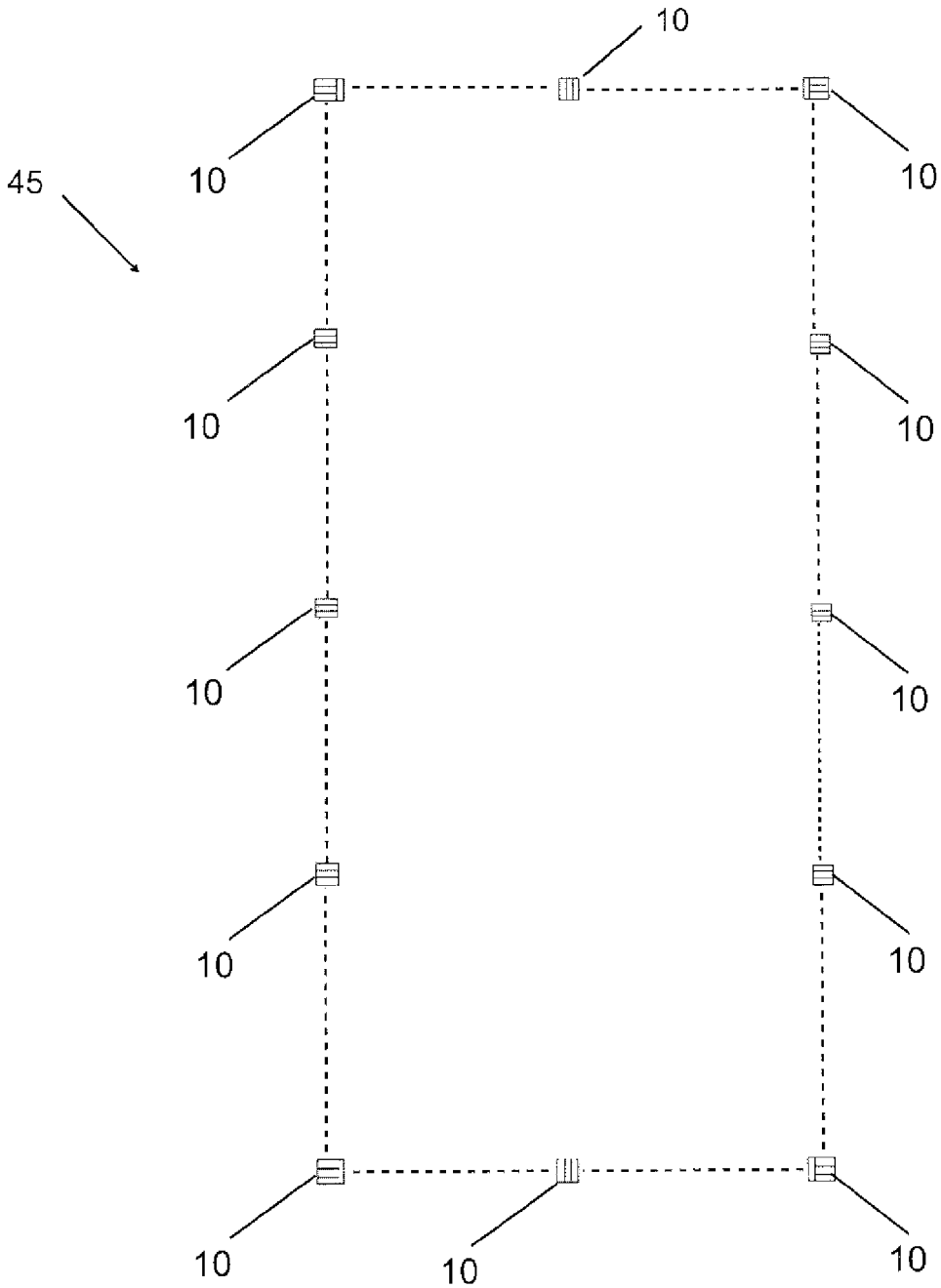
FIG. 18 depicts high and low wall sections and the support posts of the present invention forming a perimeter of a building.

Referring to FIGS. 17 and 18, the high and low sidewall sections 18, 20 or 40, 42 are positioned between and attached to the support posts 10, where the support posts 10 are positioned to define a perimeter of a building 45. The high sidewall sections 18, 40 are set on the upper ply member 62 and the low sidewall sections 20, 42 are set on the lower ply member 12.

After the high and low side wall sections 18, 20, 40, 42 are attached to the support posts 10, an under truss board 76 is cut and nailed in place onto the middle ply member 16, interposed between low and high side wall jambs 22, 24. The under truss board 76 is sized to create a truss pocket 78 configured for receiving the roof trusses, wherein the roof trusses are seated perpendicular to the sidewalls 18, 20 in the truss pockets 78.

Similarly the high and low end wall sections 40, 42 are positioned between and attached to the support posts 10. The high sidewall sections 40 set on the upper ply members 14 and the low sidewall section 20 are set on the lower ply member 12. For the corners, the corner end wall sections, either high or low wall sections 40, 42, are positioned between and attached to the support posts 10, wherein the corner side jamb of the corner end wall section is positioned on the end wall support block 72 and attached to the corner support post.

After the high and low end wall sections 40, 42 are attached to the support posts 10, the extended portions 48 of the end wall jambs 44, 46 are cut to match the pitch of the roof. A roof truss is attached to the notched section 50 of the end wall jambs 44, 46 flush with the outside surface of the end wall. The roof and purling framing is attached to the top of the trusses, similar to the traditional system as previously described.

The skirt board 52 is attached to the support posts 10 with the inner skirt 54 being flush with some of the support posts 10. Exterior siding can be seated on the outer skirt 56 and fastened to the horizontal studs 26 on the outside of the building.

In an exemplary embodiment, the support posts and skirt are made with 2×6 treated lumber, and the upper and lower wall sections are made of 2×6 untreated lumber One example of suitable lumber is white and yellow pine. However it is contemplated the support posts, upper and lower wall sections, and skirt can be made with different size and types of lumber, or different materials, for example, manufactured lumber or metal or metal alloys.

The present invention provides a flush and finished interior and exterior frame as a result of the horizontal studs stacked bookshelf style. The alignment and spacing of the horizontal stud allow, for example, the placement of fiber glass insulation or the blowing of cellulose insulation directly between the studs. Different types of interior liners can be added, for example, oriented strand board, plywood, or corrugated steel.

Additionally, doors and windows can be framed into the end walls or side walls using standard framing techniques.

The present invention can be adapted to any style, shape, or size of building. The system is able to be utilized on all building types, such as, commercial buildings, garages, stables, storage units, residential, livestock, and farm/ranch buildings etc.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A post-framing system for building construction comprising:

a plurality of laminated vertical support posts each including a plurality of vertical ply members having a first outer vertical ply member, a second outer vertical ply member, and at least one middle vertical ply member attached to and interposed between said first outer vertical ply and said second outer vertical ply members, the plurality of support posts being positionable to define a perimeter of a building, such that said second outer vertical ply members of alternating pairs of adjacent support posts face each other;

a plurality of low wall sections attached to said second outer vertical ply members of alternating pairs of adjacent support posts; and a plurality of high wall sections attached to said first outer vertical ply members of alternating pairs of adjacent support posts.

2. The post-framing system according to claim 1, further comprising a skirt assembly including an inner skirt and an outer skirt attached thereto, the inner skirt having plurality of notches configured to flushedly mount the inner skirt to at least some of the plurality of support posts.

3. The post-framing system according to claim 1, wherein interior surface of the support posts, low wall sections, and high wall sections are flush and exterior surface of the support posts, low wall sections, and high wall sections are flush.

4. The post-framing system according to claim 1, wherein each of the low wall sections includes a pair of jamb members and a plurality of horizontal members attached to and interposed between the pair of jamb members.

5. The post-framing system according to claim 4, wherein at least one of the low wall sections is a corner wall section including an angle brace.

6. The post-framing system according to claim 4, wherein at least one of the low wall sections is an end wall.

7. The post-framing system according to claim 4, wherein each of the high wall sections includes a pair of jamb members and a plurality of horizontal members attached to and interposed between the pair of jamb members.

8. The post-framing system according to claim 7, wherein at least one of the high wall sections is a corner wall section including an angle brace.

9. The post-framing system according to claim 7, wherein at least one of the high wall sections is an end wall.

10. The post-framing system according to claim 7, wherein the high wall section jamb member are shorter than the low wall section jamb members.

11. A post-framing system for building construction comprising:

a plurality of support posts each including a first outer ply member, a second outer ply member, and at least one middle ply member attached to and interposed between said first outer ply and said second outer ply members, the plurality of support posts being positionable to define a perimeter of a building, such that said second outer ply members of alternating pairs of adjacent support posts face each other;

a plurality of low wall sections attached to said second outer ply members of alternating pairs of adjacent support posts;

a plurality of high wall sections attached to the upper ply members of alternating pairs of adjacent support posts and;

a plurality of under truss boards, each positioned and attached to a truss pocket defined by adjacent high wall sections and adjacent low wall sections.

12. A method of constructing a frame for a building comprising:

providing a plurality of support posts, each including a pair of outer members and at least one middle ply member attached to and interposed between the pair of outer members;

providing a plurality low wall sections;

providing a plurality high wall sections;

positioning each of the support posts vertically in the ground thereby defining a building perimeter, wherein at least four of the support posts are a corner support post;

determining and marking the highest ground elevation on the corresponding support post;

determining a low wall base line and a high wall base line on each of the support posts;

cutting one of the pair of outer support members on each of the support posts at the low wall base line, such that a first outer ply member is formed on each of the support posts, wherein said first outer ply members face each other on alternating pairs of adjacent support posts;

cutting the opposite outer support member on each of the support posts at the high wall base line, such that a second outer ply member is formed on each of the support posts, wherein said second outer ply members face each other on alternating pairs of adjacent support posts;

preparing the corner support posts;

attaching the low wall sections to said first outer ply members; and attaching the high wall sections to said second outer ply members.

13. The method according to claim 12, further comprising attaching at least one skirt board to some of the support posts.

14. The method according to claim 13, wherein the at least one skirt board comprises an inner skirt board and an outer skirt board, the inner skirt board having a plurality of notches configured for receiving the support posts, such that the inner skirt board is flush with the support posts.

15. The method according to claim 12, further comprising attaching an under truss board to each of the support posts thereby forming a truss pocket on each of the support posts.

16. The method according to claim 12, wherein low wall sections are attached to the corner posts.

17. The method according to claim 12, wherein high and low end wall sections are attached to a gable end of the building.

18. The method according to claim 12, wherein determining the low wall base line comprises:

measuring a distance "g" up from the ground on the support post with the highest elevation;

marking the support post with the highest elevation to define the low wall base line elevation; and transferring the low wall base line elevation to each of the support posts.

19. The method according to claim 18, wherein determining the high wail base line comprises:

measuring a distance "u" up from the low wall base line on at least one support post;

marking the at least one support post to define the high wall base line elevation; and transferring the high wall base line elevation to each of the support posts.

20. The method according to claim 12, wherein preparing the corner support posts comprises:

flushing an end wall outside surface of the corner support posts; and attaching an end wall support block to the corner support post, wherein the end wall support block are positioned on the corner support post to receive a high end wall section or a low wall end wall section.

* * * * *

UNITED STATES PATENT AND TRADEMARK OFFICE

CERTIFICATE OF CORRECTION

PATENT NO. : 7,225,593 B2
APPLICATION NO. : 10/670967
DATED : June 5, 2007
INVENTOR(S) : Weston Wilhour It is certified that error appears in the above-identified patent and that said Letters Patent is hereby corrected as shown below:

Column 8, Line 1
the phrase "the upper ply" should read --said first outer ply--

Signed and Sealed this

Fourth Day of September, 2007

JON W. DUDAS
*Director of the United States Patent and Trademark Office*